US007572146B1

(12) United States Patent
Chiang

(10) Patent No.: US 7,572,146 B1
(45) Date of Patent: Aug. 11, 2009

(54) ESATA CONNECTOR INTEGRATED WITH DC POWER PINS

(75) Inventor: Jui-tu Chiang, Jhonghe (TW)

(73) Assignee: Taiwin Electronics Co., Ltd. (TW)

( * ) Notice: Subject to any disclaimer, the term of this patent is extended or adjusted under 35 U.S.C. 154(b) by 0 days.

(21) Appl. No.: 12/254,464

(22) Filed: Oct. 20, 2008

(30) Foreign Application Priority Data

Aug. 22, 2008 (TW) ..... 97215092 U

(51) Int. Cl.
*H01R 13/648* (2006.01)

(52) U.S. Cl. ..... 439/607; 439/660

(58) Field of Classification Search ..... 439/607, 439/608, 609, 660
See application file for complete search history.

(56) References Cited

U.S. PATENT DOCUMENTS

| | | | | |
|---|---|---|---|---|
| 7,255,607 | B1 * | 8/2007 | Wu | 439/660 |
| 2008/0132116 | A1 * | 6/2008 | Wu | 439/609 |
| 2008/0261448 | A1 * | 10/2008 | Yi et al. | 439/607 |
| 2009/0047839 | A1 * | 2/2009 | Wu | 439/660 |

FOREIGN PATENT DOCUMENTS

| | | | |
|---|---|---|---|
| TW | CN-2930015 | * | 8/2007 |
| TW | CN-201112885 | * | 9/2008 |
| TW | CN-201134590 | * | 10/2008 |

* cited by examiner

*Primary Examiner*—Neil Abrams
*Assistant Examiner*—Phuong Nguyen
(74) *Attorney, Agent, or Firm*—Hershkovitz & Associates, LLC; Abraham Hershkovitz

(57) ABSTRACT

An eSATA connector integrated with DC power pins has a body, an eSATA terminal set, a power terminal set and a metal housing. The body is formed with an open groove and multiple through grooves respectively in a front surface and a rear surface. The eSATA terminal set has multiple signal terminals in parallel. A front electrical connection section of each signal terminals is mounted in the open groove. A rear soldering section of each signal terminals penetrates backwards through the through hole. Two power terminals are respectively mounted in two opposite outer sidewalls of the body respectively, at a height corresponding to the eSATA terminal set. When the eSATA connector connects to a matching eSATA socket on a motherboard, the two power terminals contact power terminals in the socket and obtain power to save wires and cost for the connection with an external power supply.

13 Claims, 16 Drawing Sheets

ESATA CONNECTOR INTEGRATED WITH DC POWER PINS

BACKGROUND OF THE INVENTION

1. Field of the Invention

The invention relates to an eSATA connector and, in particular, to an eSATA connector integrated with DC power pins.

2. Description of Related Art

To effectively transmit data between computers and computer peripherals, there are connectors using different communication protocol standards. In view of the trend that computer products become more compact, the connectors also become thinner. In particular, connectors of the serial transmission are most popular. These include the external serial advanced technology attachment (eSATA), universal serial bus (USB), etc.

Since the USB connector includes two DC terminals according to its protocol standard, computer peripherals that use the USB connector do not need extra external power. Therefore, the computer peripheral can obtain its working power after it is inserted into the USB connector of the computer. This is very convenient. Due to its original protocol standard, the eSATA connector requires an external power supply to function normally. However, the eSATA protocol standard is higher than the USB protocol standard. Thus, the eSATA connector is very popular in computers and computer peripherals. The design of an external power supply does not only increase the cost of the product using the eSATA connector, it is also difficult for the product to become compact. Therefore, it is necessary to further improve the eSATA connector.

SUMMARY OF THE INVENTION

In view of the foregoing problems in the existing eSATA connector, an objective of the invention is to provide an eSATA connector integrated with internal power pins.

To achieve the above-mentioned objective, the disclosed eSATA connector includes a body, an eSATA terminal set, a power terminal set and a metal housing.

The front surface of the body is forward inwards with an open groove. The rear surface of the open groove is formed with a plurality of through holes communicating with the open groove.

The eSATA terminal set includes a plurality of horizontally disposed signal terminals, each having a front electrical connection section and a rear soldering portion. The front electrical connection section of each signal terminal is fixed in the open groove of the body. The rear soldering section goes through the corresponding through hole on the body.

The power terminal set includes two power terminals disposed on the two opposite outer sides of the body and parallel to the eSATA terminal set. The rear soldering section of each power terminal goes into the body and protrudes from the back side of the body for soldering.

The metal housing encloses the outer side of the body, exposing the open groove, the rear soldering section of the eSATA terminal set, and the power terminals.

The above-mentioned connector is featured in having a power terminal set on the two opposite outer sides of the body for the insertion into a matching eSATA socket. The power terminal set has a direct contact with the two power pins on the inner side of the eSATA socket, thereby obtaining working power for the eSATA connector. In addition to saving wires and cost for the connection with an external power supply, the invention is also very convenient in use.

Another objective of the invention is to provide an eSATA connector integrated with a USB terminal set. Inside the body of the connector is provided with a plurality of parallel USB signal terminals that are not in contact with the eSATA signal terminals. When the connector is inserted into a matching eSATA socket, the eSATA connector can receive the 5 V DC power of the USB terminal set, as well as the DC power below 24 V provided by the two power pins on the two sides of the eSATA terminal set.

A further objective of the invention is to provide an eSATA connector integrated with two different USB protocol standards. The body of the connector has a first USB terminal set and a second USB terminal set. They form with the eSATA terminal set a three-in-one connector. When it is inserted into a matching eSATA socket, the eSATA connector can simultaneously enjoy the 5 V DC power of the USB terminal set, as well as the DC power below 24 V provided by the two power pins on the two sides of the eSATA terminal set.

DETAILED DESCRIPTION OF THE PREFERRED EMBODIMENT

Figure 1:
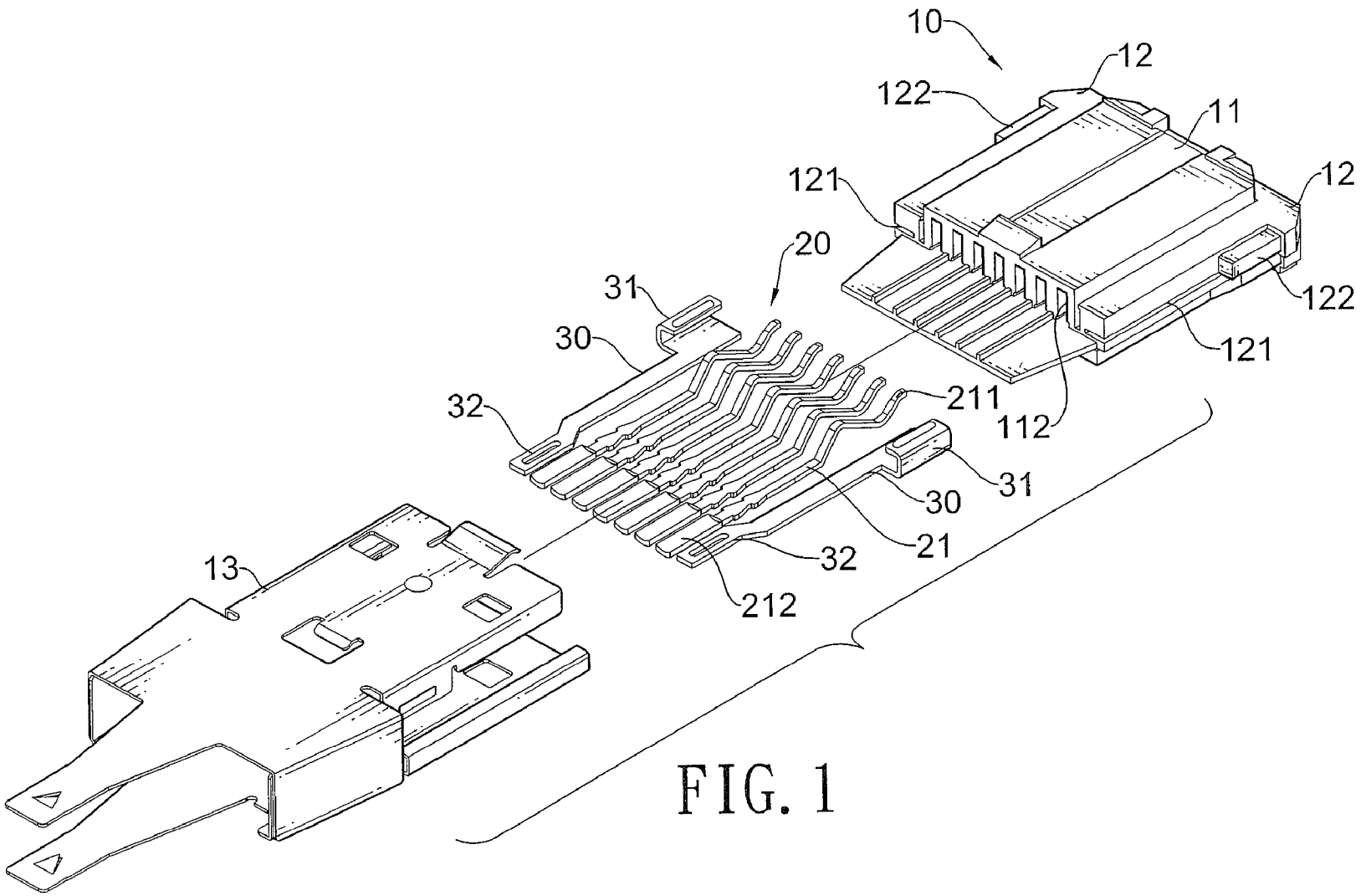
FIG. 1 is an exploded perspective view of a first embodiment of an eSATA connector in accordance with the present invention.
Figure 2:
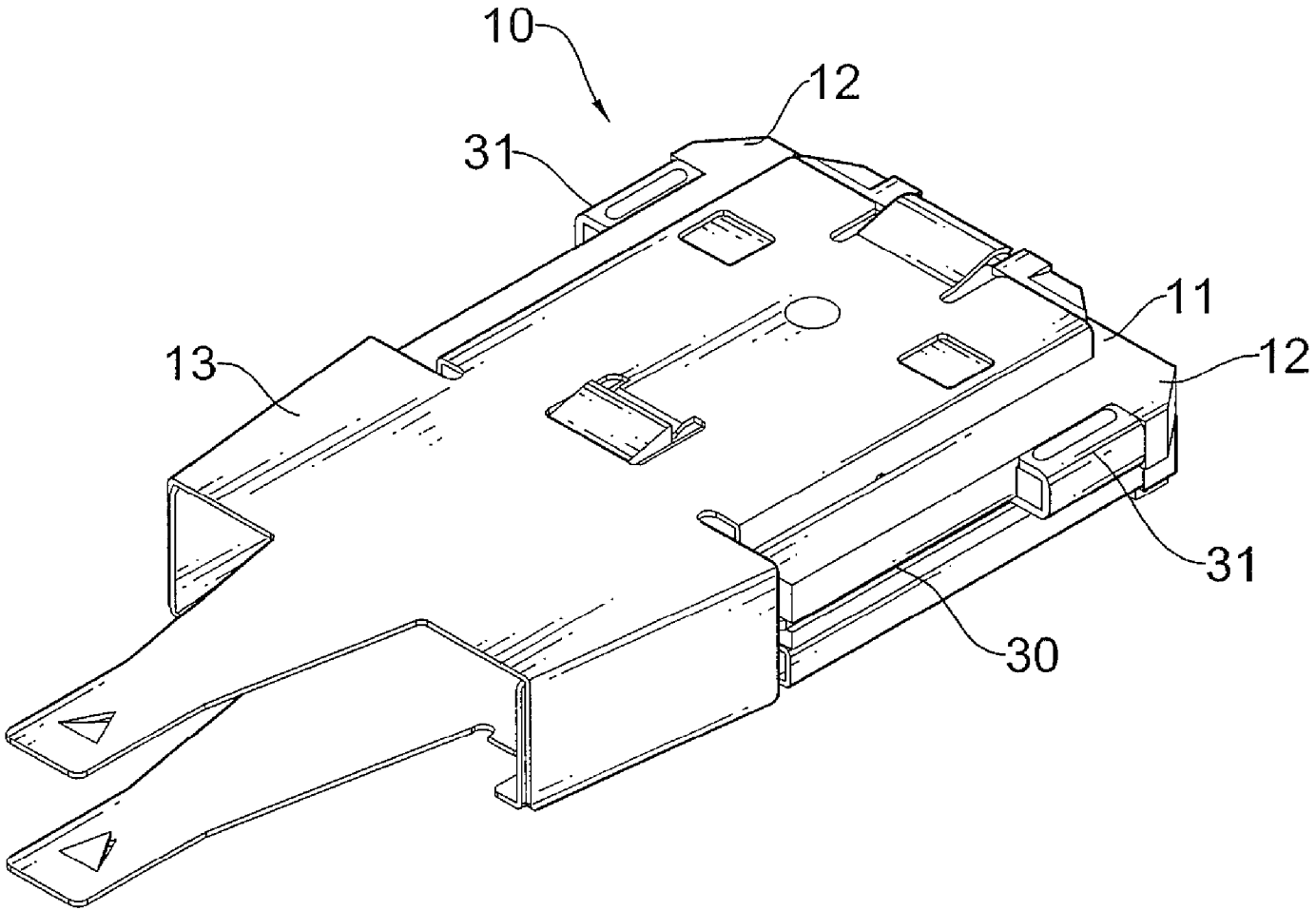
FIG. 2 is a perspective view of the assembled eSATA connector of FIG. 1.
Figure 3:
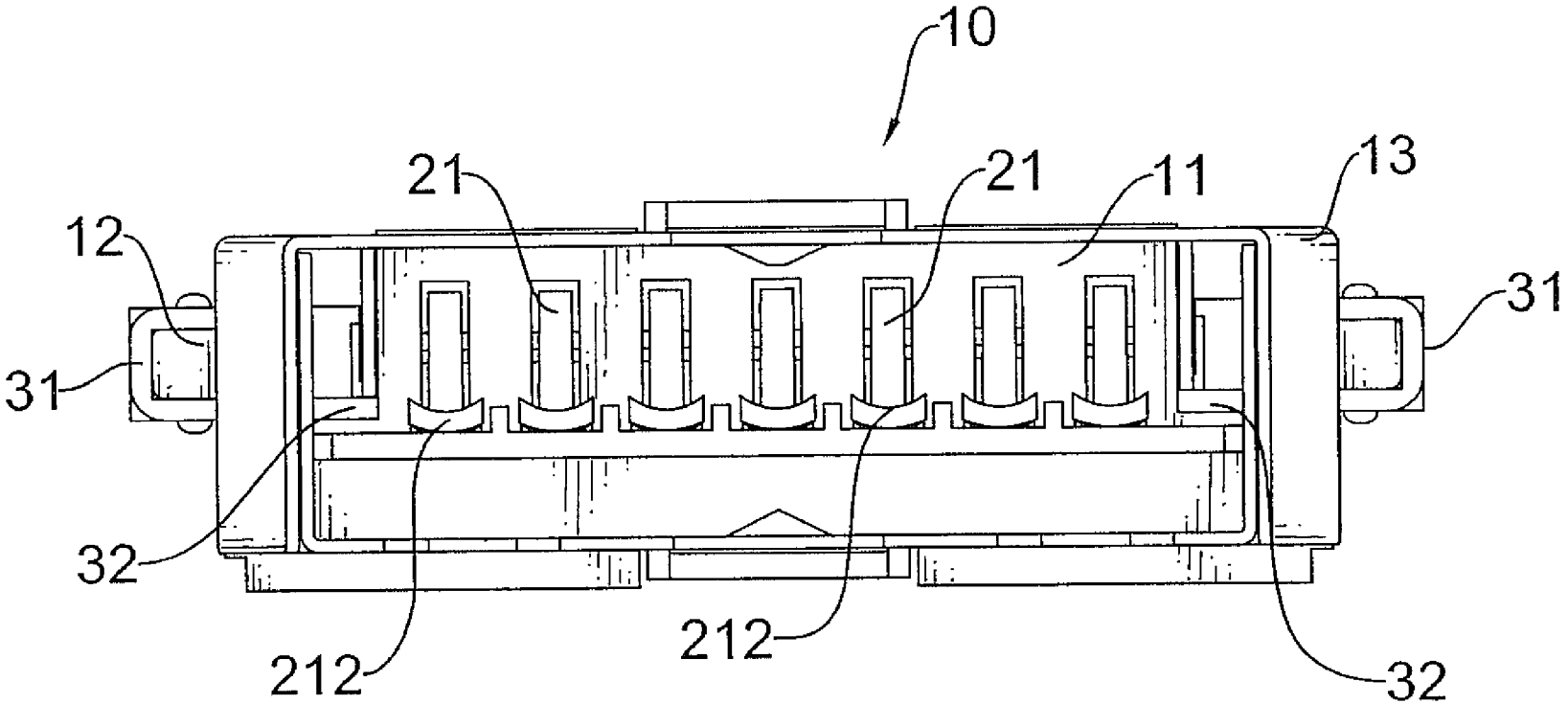
FIG. 3 is a rear plan view of the eSATA connector in accordance with the present invention.

With reference to FIGS. 1 to 4, a first embodiment of an eSATA connector 10 comprises a body 11, an eSATA terminal set 20, a power terminal set, and a metal housing 13.

The body 11 has a front surface formed inward with an open groove 111. The body 11 has a rear surface formed with multiple first through grooves 112 that communicate with the open groove 111. In this first embodiment, two outer opposite sides 12 of the body 11 near the front surface are formed with a rectangular blocks 122, respectively. The two outer sides 12 are further formed with a mounting groove 121, respectively.

The eSATA terminal set 20 includes seven signal terminals 21 being arranged in parallel. Each signal terminal 21 has a front electrical connection section 211 and a rear soldering section 212. The front electrical connection sections 211 are mounted in the open groove 111 of the body 11. The rear soldering sections 212 respectively extend through the first through grooves 112 on the back wall of the body 11, protruding outward for soldering.

The power terminal set has two power terminals 30 mounted respectively on the two outer sides 12 of the body 11 and parallel to the seven signal terminals 21 of the internal eSATA terminal set 20. In this first embodiment, each power terminal 30 is embedded in the mounting groove 121 on either outer side 12 of the body 11. Each power terminal 30 has a front electrical connection section 31 and a rear soldering section 32. The front electrical connection section 31 is bent upwards to form a U shape to cover the rectangular block 122. The rear soldering section 32 penetrates through the rear surface of the body 11 for soldering. Since the eSATA protocol uses a DC voltage below 24 V being higher than the voltage and currents transmitted by the seven signal terminals 21, the volume of each power pin 30 is larger than that of each signal terminal 21 of the eSATA terminal set 20 in order to convey stronger power.

The metal housing 13 encloses the body 11 and exposes the open groove 111, the rear soldering section 212 of the signal terminal 21 in the eSATA terminal set 20, and the rear soldering section 32 of the power terminal 30.

Figure 4:
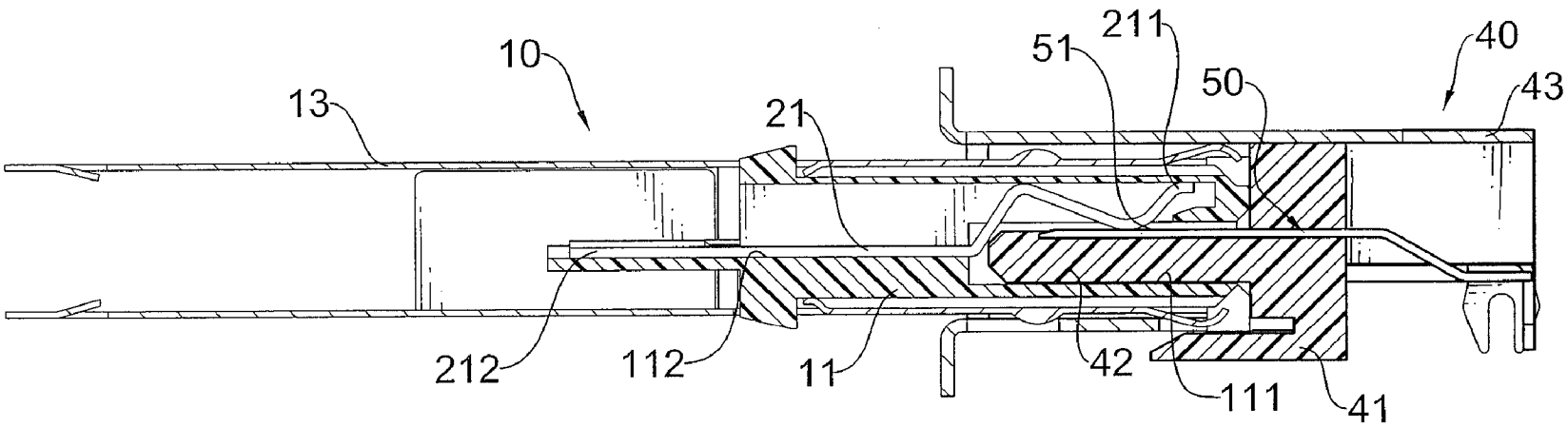
FIG. 4 is a side cross-sectional view of the eSATA connector in accordance with the present invention and an eSATA socket before they are connected.
Figure 5:
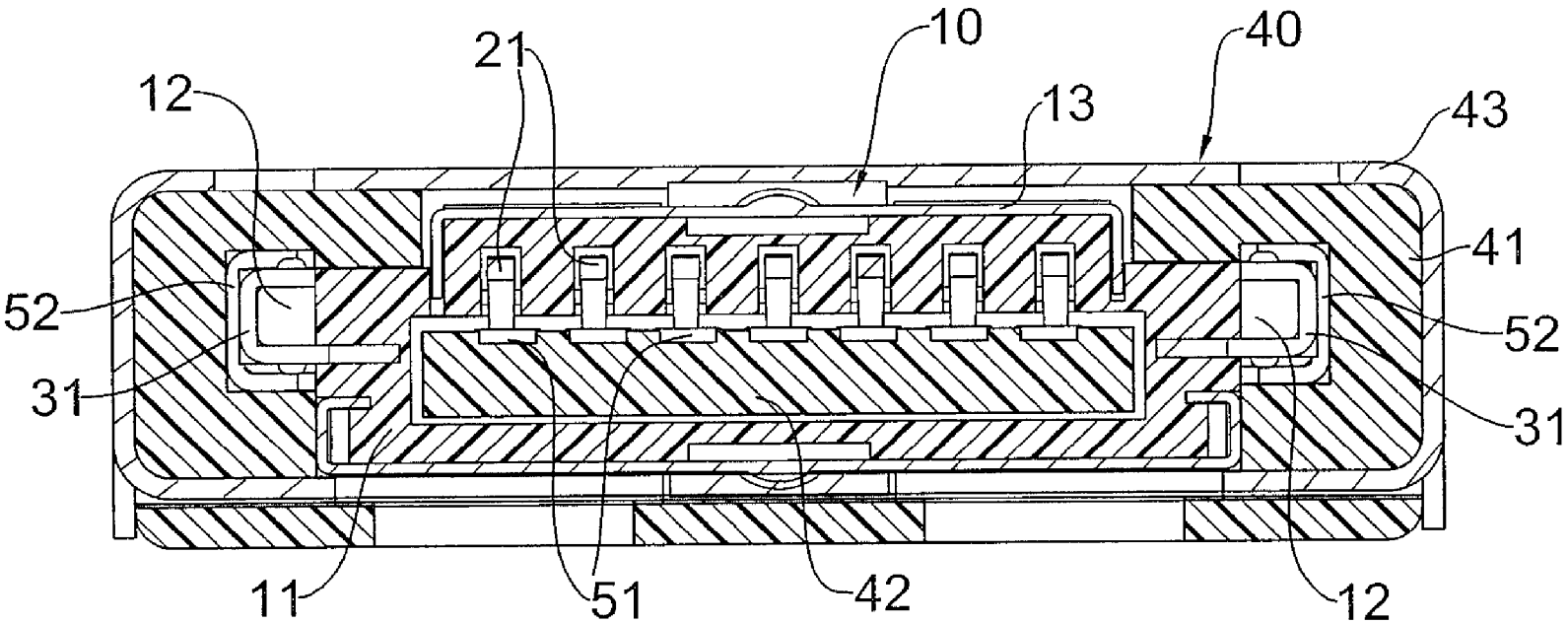
FIG. 5 is a partial cross-sectional view of the eSATA connector in accordance with the present invention being connected to an eSATA socket.
Figure 6:
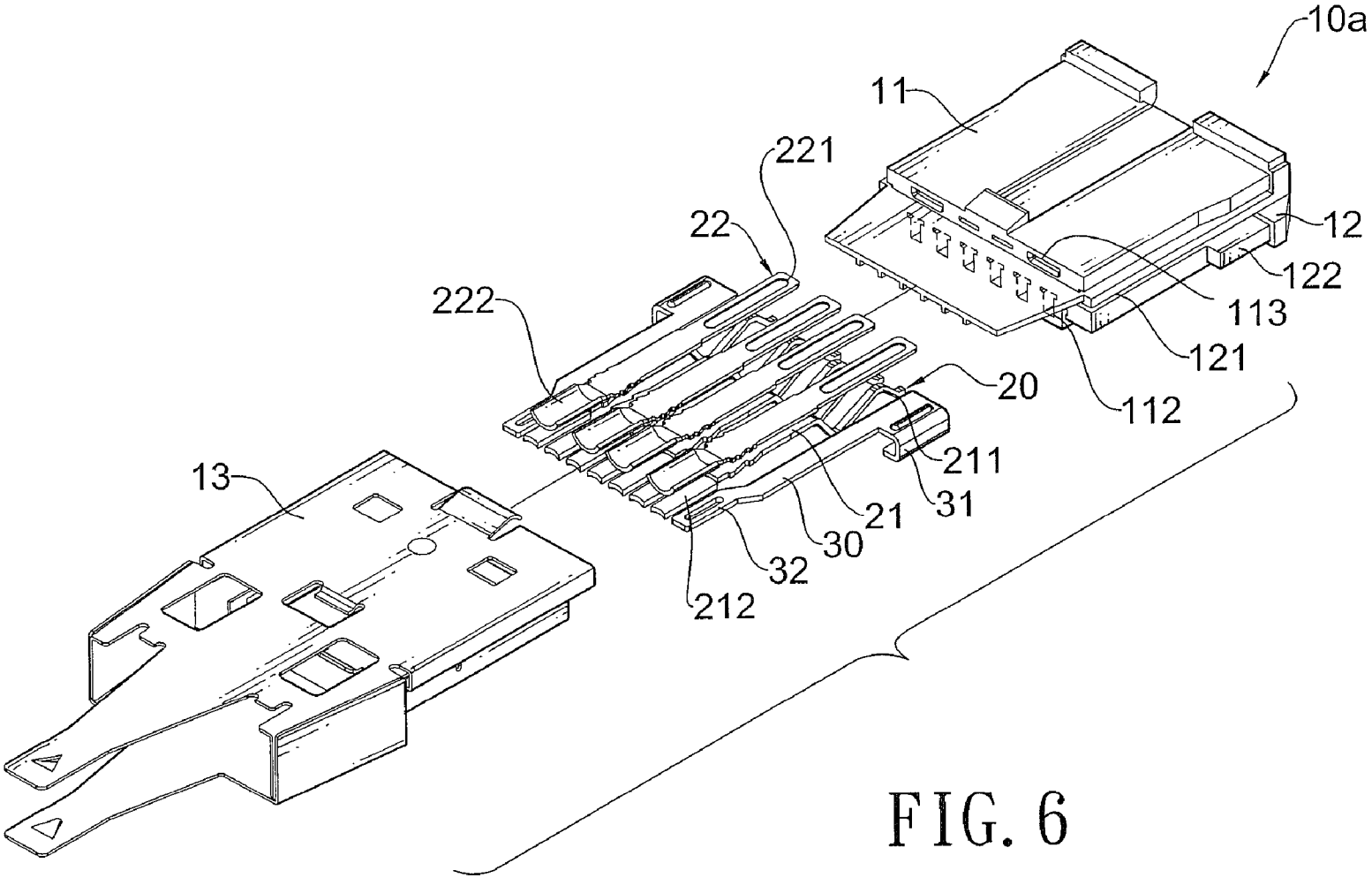
FIG. 6 is an exploded perspective view of a second embodiment of the eSATA connector in accordance with the present invention.
Figure 7:
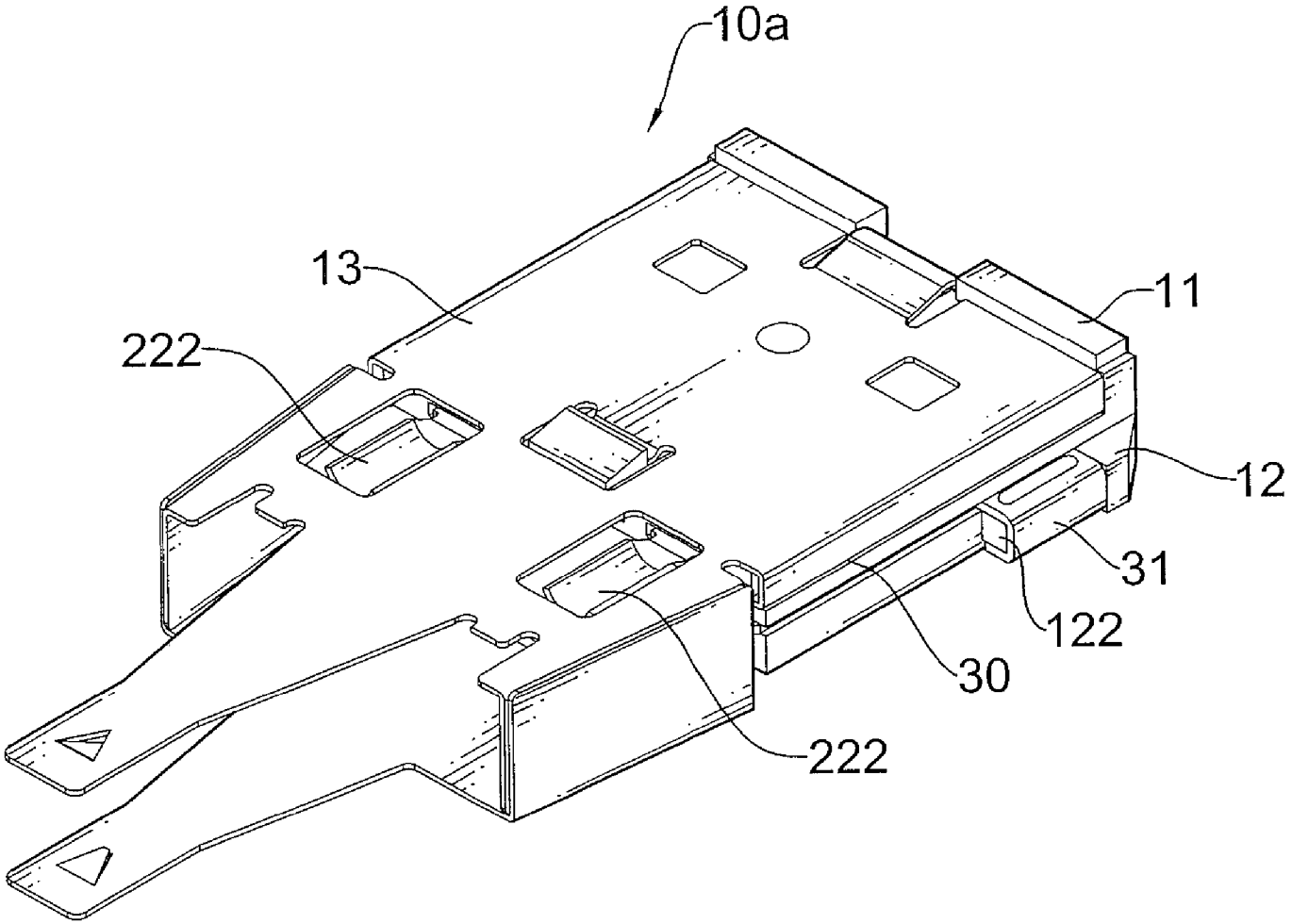
FIG. 7 is a perspective view of the assembled eSATA connector of FIG. 6.
Figure 8:
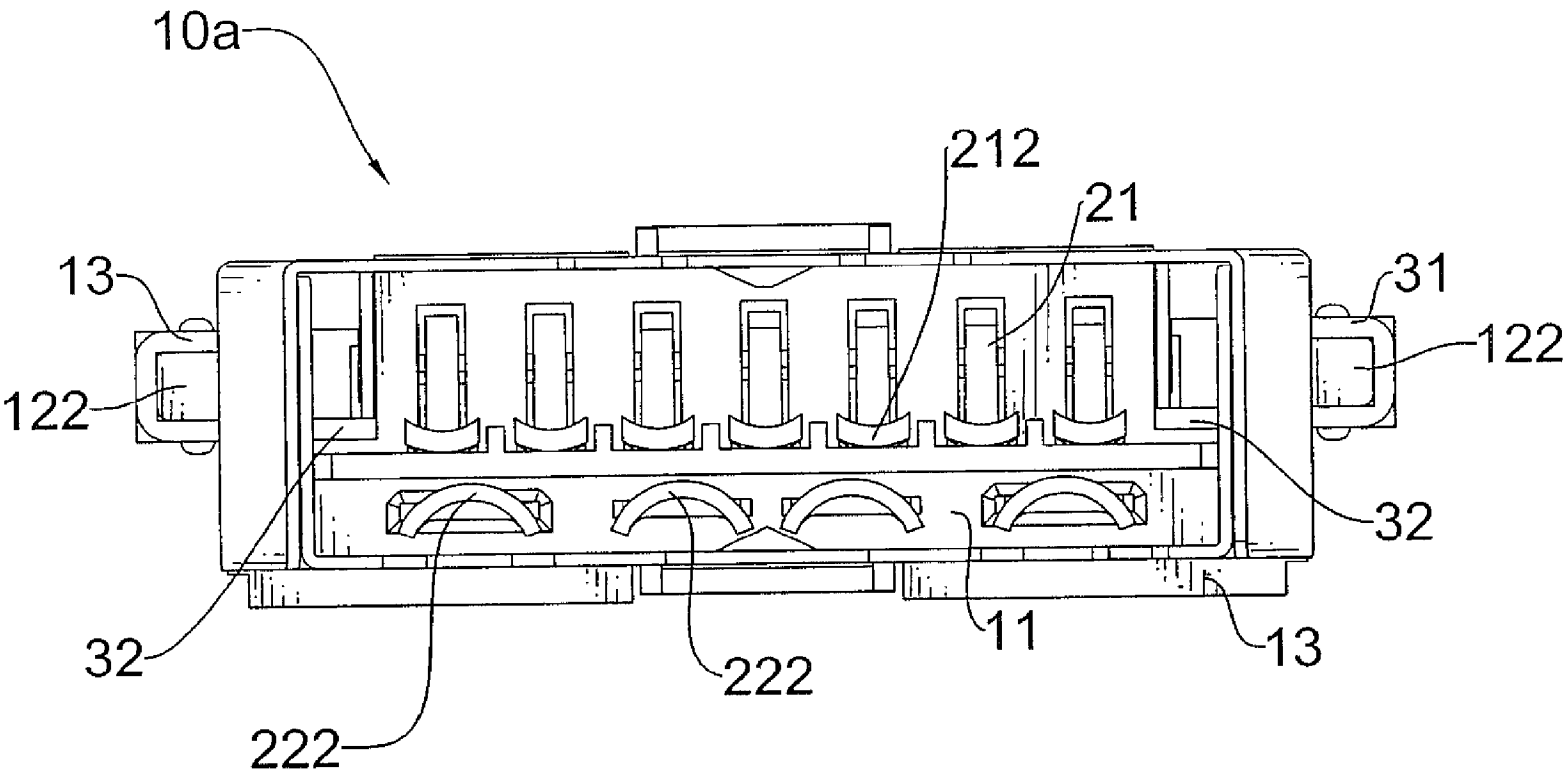
FIG. 8 is a rear plan view of FIG. 7.

With further refer to FIGS. 4 and 5, the eSATA connector 10 according to the first embodiment is to be connected to an eSATA socket 40 integrated with a power terminal set. A body 41 of the eSATA socket 40 is provided with a connecting plate 42 on which an eSATA terminal set 50 is disposed. The eSATA terminal set 50 includes seven eSATA pins 51. Two opposite inner sides of the body 41 corresponding to the eSATA terminal set 50 are respectively disposed with two power pins 52 whose cross section has a U shape. Since the eSATA socket 40 is soldered onto the motherboard that provides power to the eSATA socket 40, the power pins 52 can receive a DC voltage below 24 V. Therefore, when the eSATA connector 10 is inserted into the socket 40, the front electrical connection section 31 of the power terminal 30 in the body 11 electrically contacts the two power pins 52 on the inner sides of the socket 40, and obtains the power for the eSATA terminal set 20.

With reference to FIGS. 6 to 9 for a second embodiment of the invention, the second embodiment is basically the same as the first embodiment. A first USB terminal set having four first USB terminals 22 is further stacked above or below the seven signal terminals 21 of the eSATA terminal set 20. However, the eSATA terminal set 20 and the USB terminal set are not in touch with each other. This renders a two-in-one connector. In this second embodiment, the first USB terminal set is stacked above the eSATA terminal set 20.

Moreover, the rear surface of the body 11 is formed with a row of four second through grooves 113, corresponding to the four first USB terminals 22 of the first USB terminal set. That is, a front electrical connection section 221 of each of the first USB terminals 22 is disposed in the body 11. A rear soldering section 222 of each of the first USB terminals 22 penetrates through the corresponding second through groove 113 toward the rear surface of the body 11 for soldering.

Figure 9:
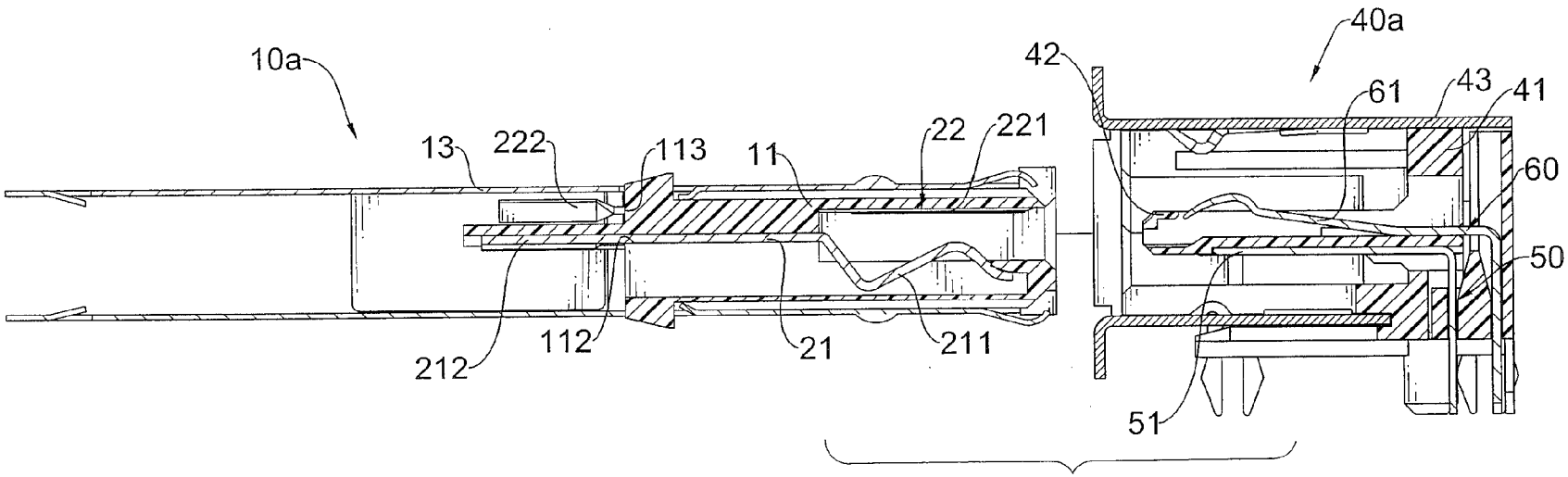
FIG. 9 is a side cross-sectional view of the eSATA connector of FIG. 6 and an eSATA socket before they are connected.
Figure 10:
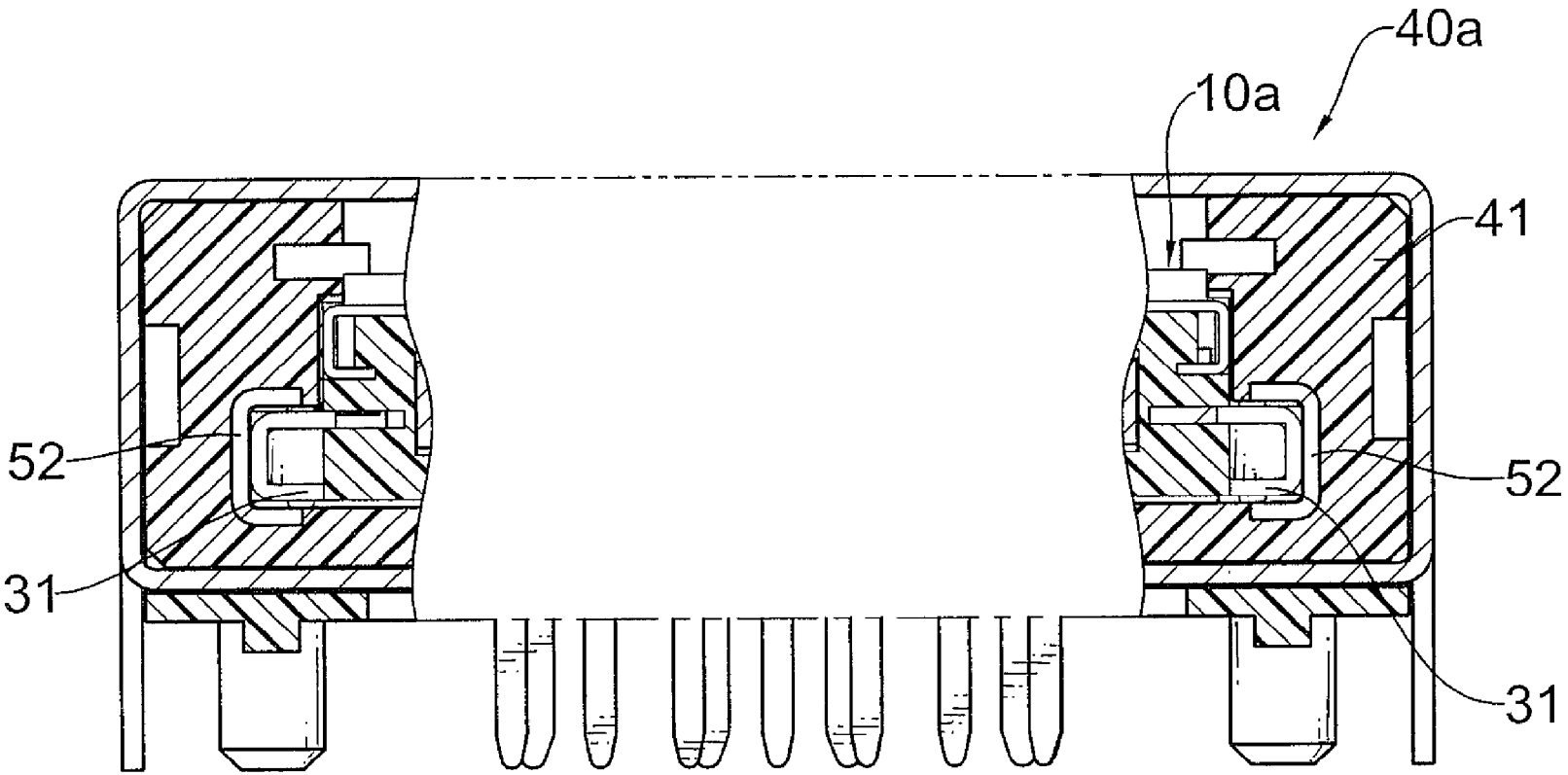
FIG. 10 is a partial cross-sectional view of the eSATA connector of FIG. 6 being connected to the eSATA socket.
Figure 11A:
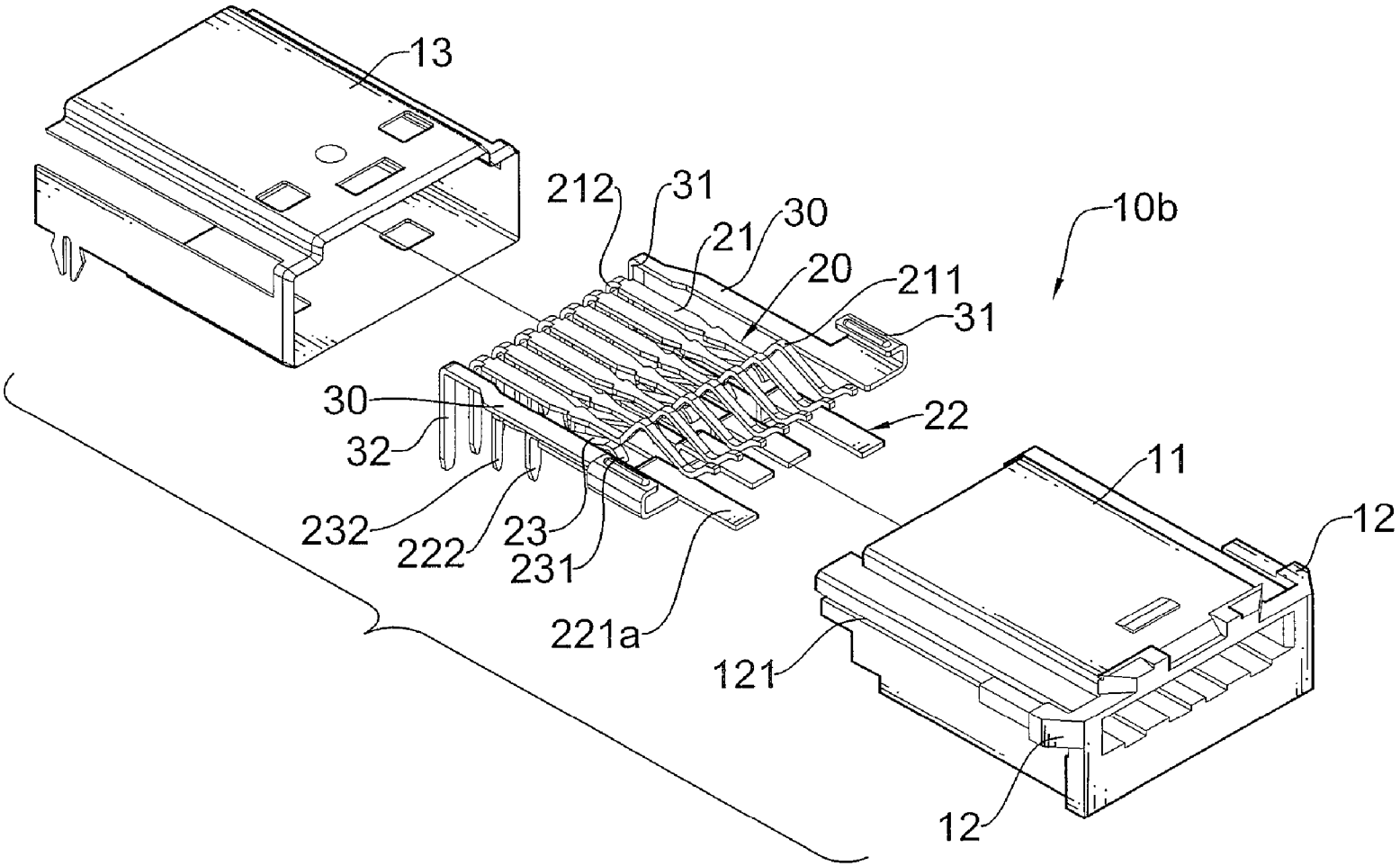
FIG. 11A is an exploded perspective view of the a third embodiment of an eSATA connector in accordance with the present invention.
Figure 11B:
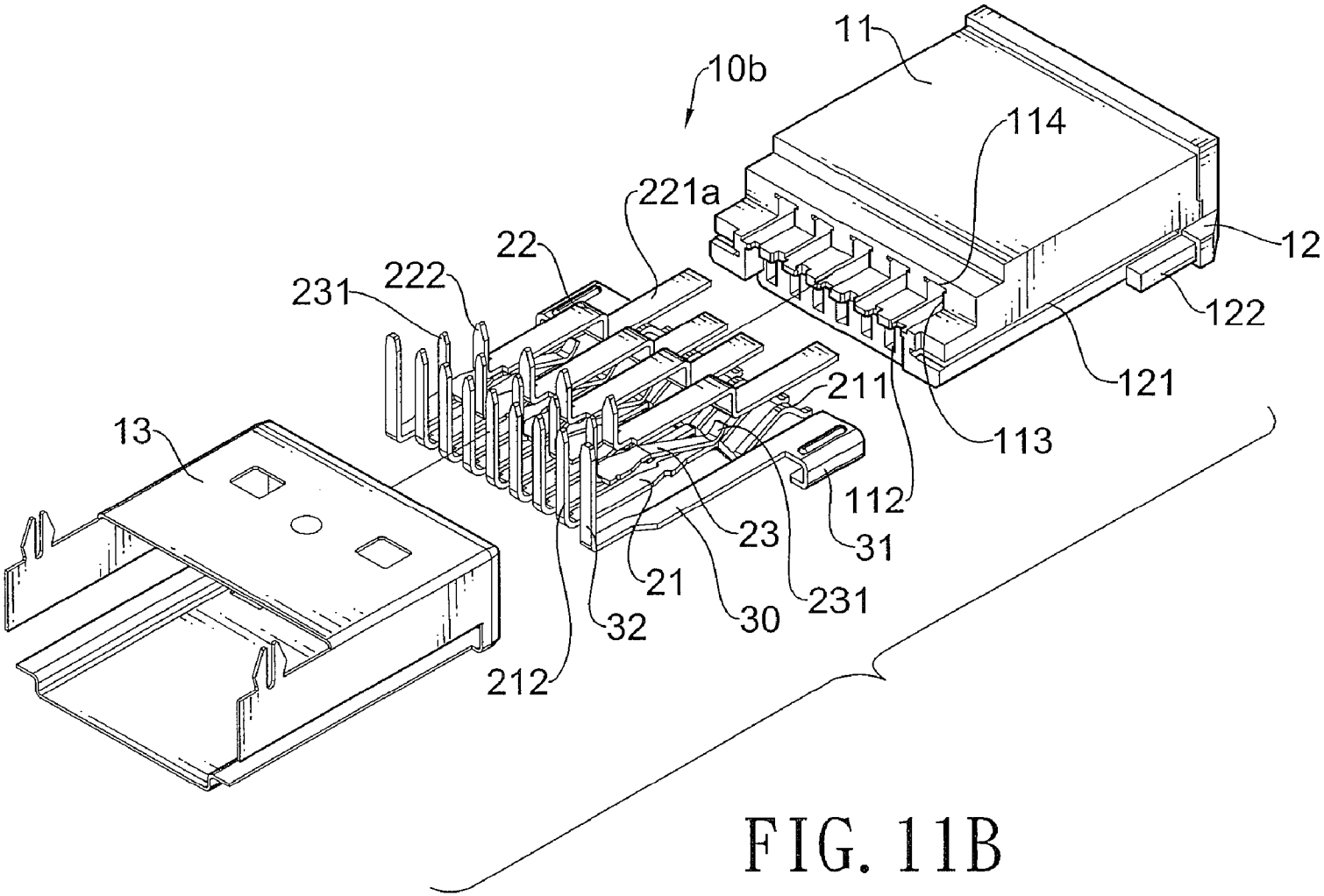
FIG. 11B is another exploded perspective view of the third embodiment of the eSATA connector.
Figure 12:
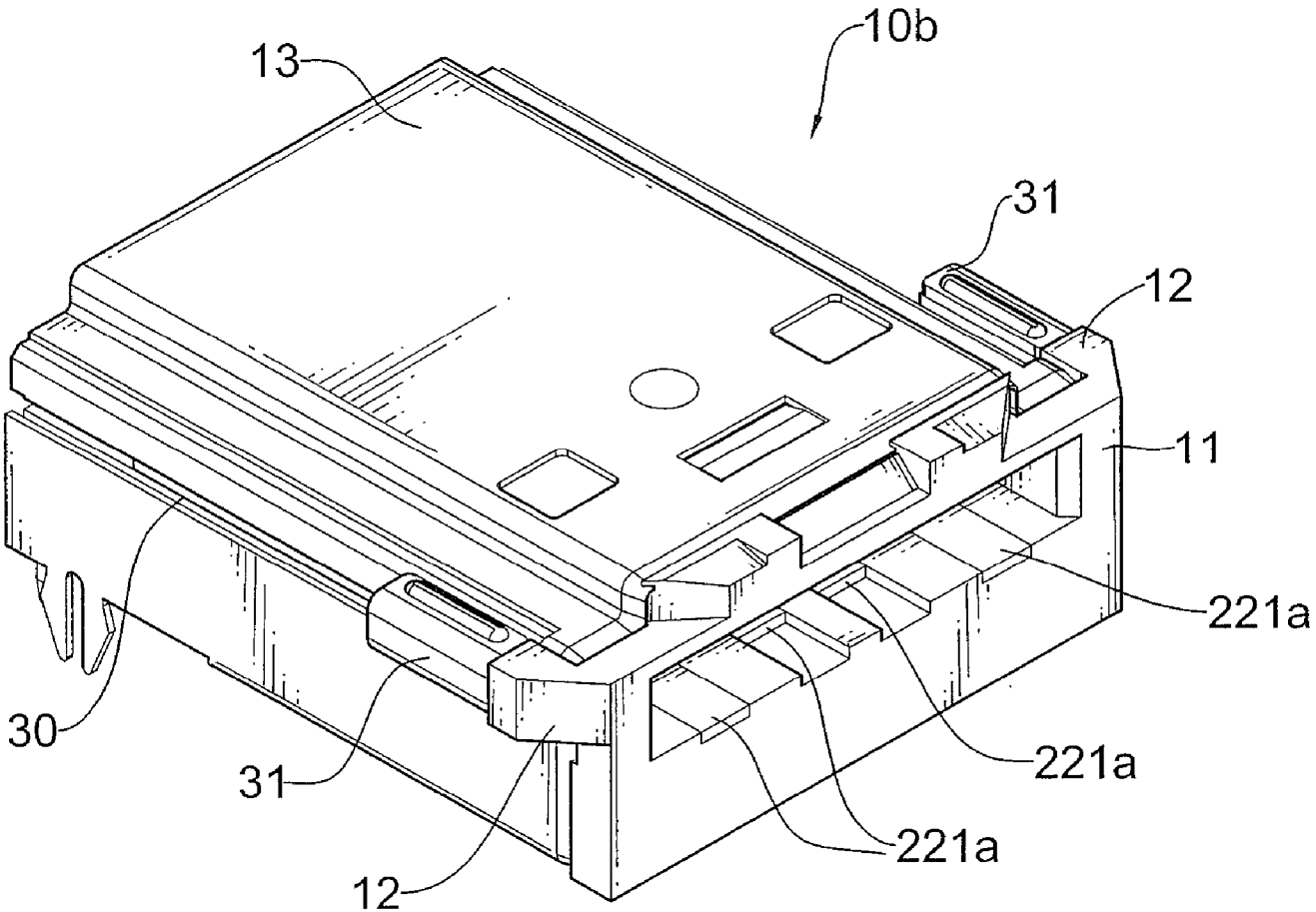
FIG. 12 is a perspective view of the third embodiment of the eSATA connector.
Figure 13:
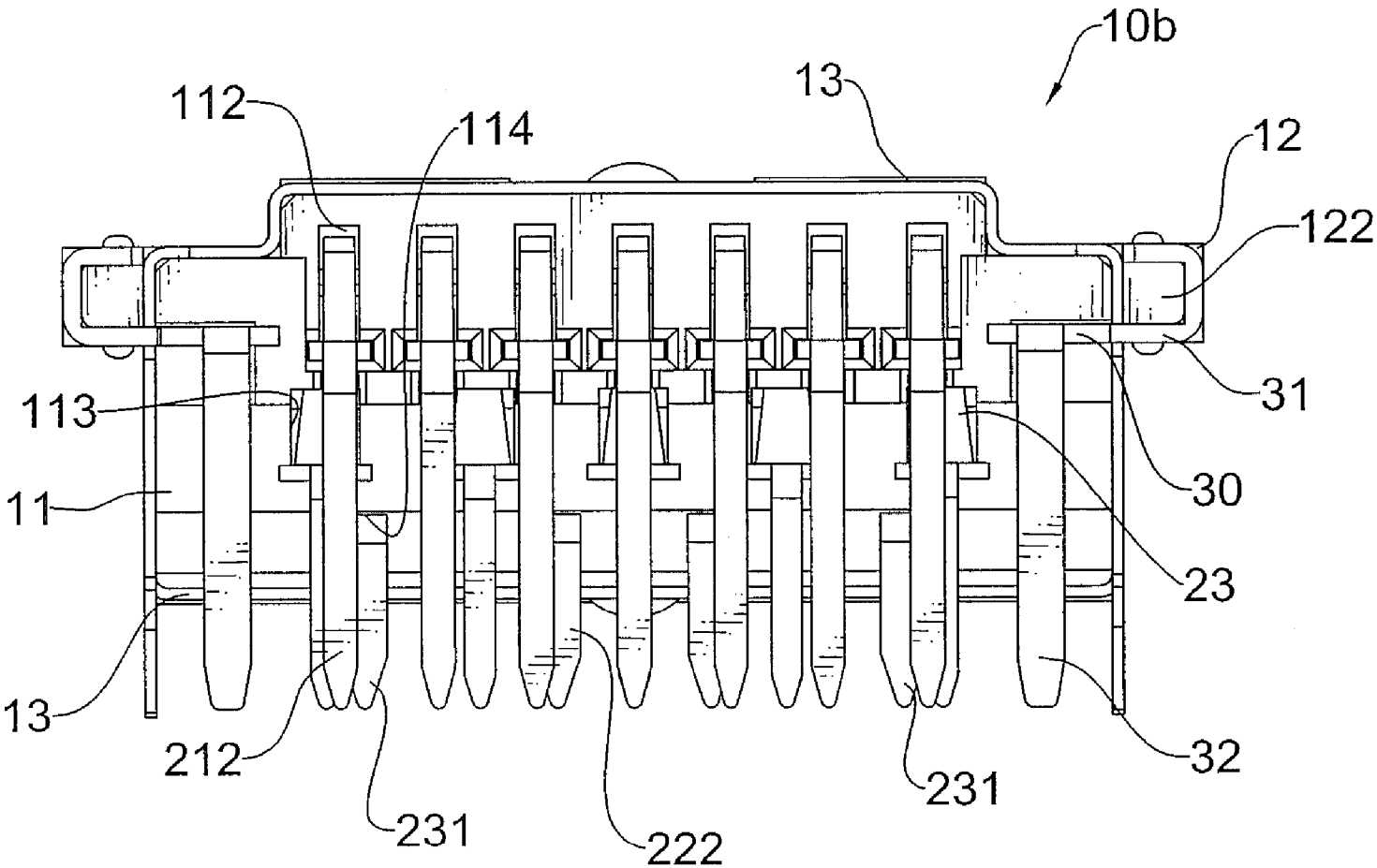
FIG. 13 is a rear plan view of FIG. 11.
Figure 14:
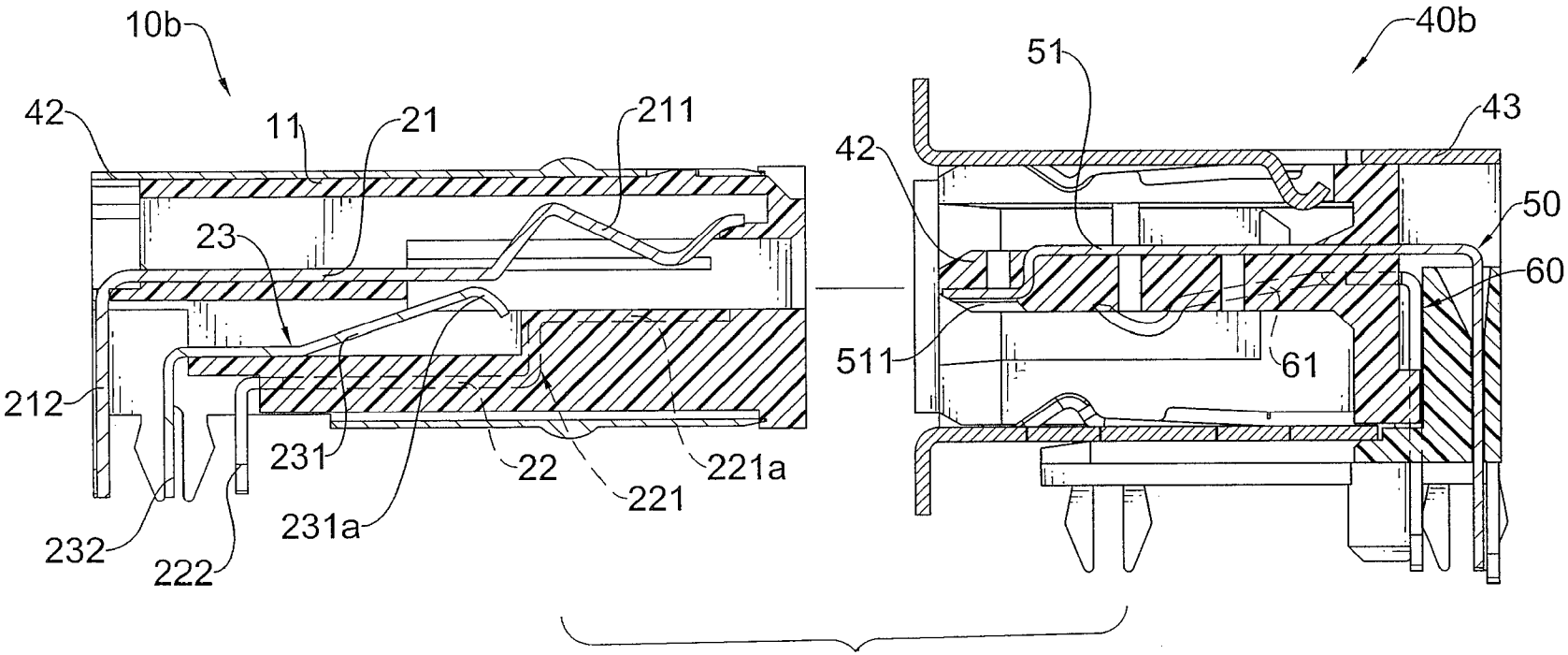
FIG. 14 is a side cross-sectional view of the eSATA connector of FIG. 12 and an eSATA socket before they are connected.

With further reference to FIGS. 9 and 10, the eSATA connector 10*a* according to the second embodiment is connected to an eSATA socket 40*a* integrated with a power terminal set. The two opposite surfaces of the connecting plate 42 on the body 41 of the eSATA socket 40 are disposed respectively with an eSATA terminal set 50 and a USB terminal set 60. The two sides on the body 41 corresponding to the eSATA terminal set 50 are disposed respectively with a power pin 52 whose cross section has a U shape. Since the eSATA socket 40*a* is soldered onto the motherboard that provides power to the eSATA socket 40*a*, the power pins 52 receive a DC voltage below 24 V. The motherboard also provides the USB with a 5 V DC voltage. Therefore, when the eSATA connector 10*a* is inserted into the socket 40*a*, the front electrical connection section 31 of the power terminal 30 inside the body 11 is in touch with the two power pins 52 in the socket 40*a*. In this case, the eSATA terminal set 20 of the connector 40*a* obtains the power from both the USB terminal set and the power terminal set 30.

With reference to FIGS. 11A, 11B to 14, a third embodiment of the an eSATA connector 10*c* is basically the same as the first embodiment in structure. In this third embodiment, the body is provided with a first USB terminal set and a second USB terminal set having four first USB terminals 22 and four second USB terminals 23, respectively. The first and second USB terminal sets are stacked with the eSATA terminal set 20. However, they do not touch each other. The rear surface of the body 11 is formed with a first group of through grooves 112, a second group of through grooves 113, and a third group of through grooves 114 respectively for the rear soldering sections 32, 222, 232 of the eSATA terminal set 20 and the first and second USB terminals 22, 23 to go through. The rear soldering sections 32, 222, 232 protrude from the body 11 for soldering. In this third embodiment, each of the rear soldering sections 32, 222, 232 is further bent downwards after they protrude from the body 11.

In this third embodiment, the front electrical connection section 211 of the signal terminal 21 in the uppermost eSATA terminal set 20 of the body 11 is bent. The front electrical connection section 221 of each first USB terminal 22 in the lowermost first USB terminal set of the body 11 is formed upwards with an upper ladder part 221*a*. The front electrical connection section 23 of each of the second usb terminals 23 in the second USB terminal set between the eSATA terminal set 20 and the first USB terminal set is shorter than the front electrical connection sections 211, 221 of the signal terminals 21, 22 in the eSATA terminal set 20 and the first USB terminal set. The front end of the front electrical connection section 231 of each of the second USB terminals 23 is bent upwards to form a bending part 231*a* at a height corresponding to the upper ladder part 221*a* of the first USB terminal 22 in the first USB terminal set.

Figure 15:
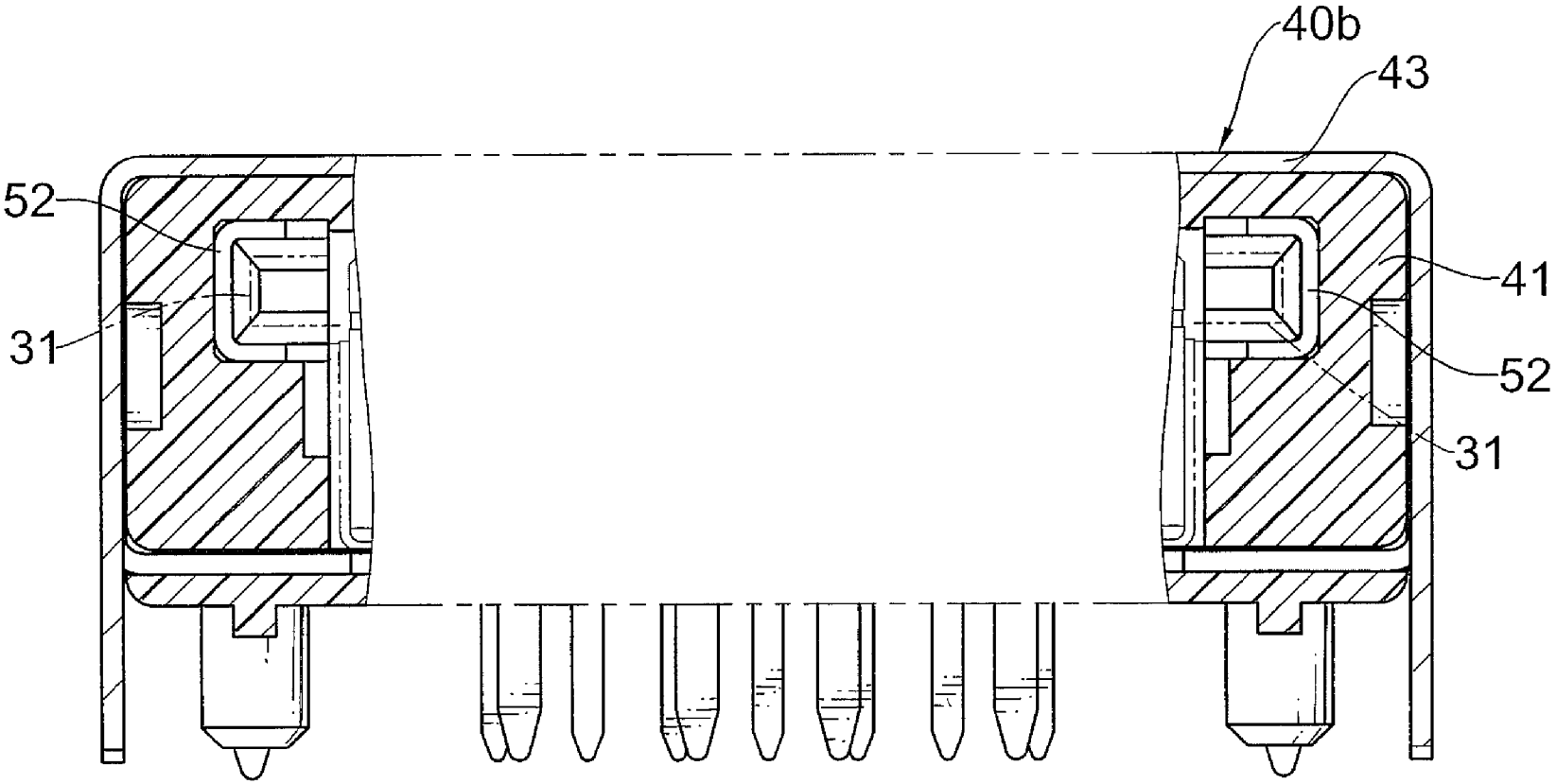
FIG. 15 is a partial cross-sectional view of the eSATA connector of FIG. 12 being connected to the eSATA sockets.

With reference to FIG. 15, a third embodiment of the eSATA connector 10*b* is inserted in an eSATA socket 40*b* integrated with a power terminal set. The two opposite surfaces of the connecting plate 42 of the body 41 of the eSATA socket 40*b* are provided with an eSATA terminal set 50 having seven pins 51 and a USB terminal set 60 having four USB terminals 61 that complies USB 2.0 standard. Five pins 51 of the eSATA terminal set 50 go through the connecting plate 42 and have downward bending ladder parts 511 at the opposite surface. The five downward bending ladder parts 511 are on the same surface of the connecting plate 42 as the USB terminal set 60 that complies with USB 3.0 standard. The five downward bending ladder parts 511 are closer to the front end of the connecting plate 42 than the USB terminal set 60.

When the disclosed eSATA connector 10*b* is inserted into such a socket 40*b*, the front electrical connection sections 311 of the power terminals 30 in the body 11 are in touch with the two power pins 52 on the inner sides of the socket 40. The eSATA terminal set 20 in the connector 10*b* receives power from the USB terminal set and the power terminal set.

From the description of the above-mentioned three embodiments, it is clear that the invention is featured in having a power terminal set on the two opposite outer sides of the body. After it is inserted into a matching eSATA socket, the power terminal set is in touch with the two power pins inside the eSATA socket, thereby obtaining the working power for the eSATA connector. In addition to saving wires and cost for the connection with an external power supply, it is also very convenient in use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An external serial advanced technology attachment (eSATA) connector comprising:

a body comprising a front surface, a rear surface, two outer opposite sides and having an open groove defined on the front surface inward the body; and multiple first through grooves arranged in a row defined on the rear surface of the body and communicating with the open groove;

an eSATA terminal set comprising a plurality of signal terminals arranged horizontally, each of the signal terminals having a front electrical connection section mounted in the open groove of the body; and a rear soldering section penetrating through a corresponding first through groove of the body for soldering;

a power terminal set comprising two power terminals mounted on the two outer opposite sides of the body and in parallel with the signal terminals of the eSATA terminal set; and a metal housing covering the body so that the open groove, the rear soldering sections of the signal terminals of the eSATA terminal set, and the rear soldering sections of the power terminals are exposed.

2. The eSATA connector as claimed in claim 1, wherein two rectangular block are formed outwards on the two outer opposite sides of the body near the front surface, respectively;

two mounting grooves are formed in the two outer opposite sides;

each of the two power terminal has a front electrical connection section with a U-shaped cross-section and mounted in one of the mounting grooves, the front electrical connection section of each power terminal covering one of the two rectangular block.

3. The eSATA connector as claimed in claim 2, wherein each of the power terminals has a larger volume than each signal terminal of the eSATA terminal set.

4. The eSATA connector as claimed in claim 1 further comprising:

a universal serial bus (USB) terminal set that has a plurality of USB terminals arranged in parallel, each USB terminal having a front electrical connection section and a rear soldering section;

the body further having multiple second through grooves defined in the rear surface of the body and arranged in a row, wherein the front electrical connection sections of the USB terminals are mounted in the open groove of the body, and the rear soldering sections of the USB terminals extending through the second through grooves of the body respectively for soldering.

5. The eSATA connector as claimed in claim 4, wherein two rectangular block are formed outwards on the two outer opposite sides of the body near the front surface, respectively;

two mounting grooves are formed in the two outer opposite sides;

each of the two power terminal has a front electrical connection section with a U-shaped cross-section and mounted in one of the mounting grooves, the front electrical connection section of each power terminal covering one of the two rectangular block.

6. The eSATA connector as claimed in claim 5, wherein each of the power terminals has a larger volume than each signal terminal of the eSATA terminal set.

7. The eSATA connector as claimed in claim 1, further comprising:

multiple second through grooves defined in the rear surface of the body and communicating with the open groove;

multiple third through grooves defined in the rear surface of the body and communicating with the open groove;

a first USB terminal set comprising a plurality of first USB terminals arranged in parallel, each first USB terminal having a front electrical connection sections mounted in the open groove and a rear soldering section extending through a corresponding one of the second through grooves of the body for soldering; and a second USB terminal set comprising a plurality of second USB terminals arranged in parallel, each second USB terminal having a front electrical connection sections mounted in the open groove and a rear soldering section extending through a corresponding one of the third through grooves of the body for soldering.

8. The eSATA connector as claimed in claim 7, wherein two rectangular block are formed outwards on the two outer opposite sides of the body near the front surface, respectively;

two mounting grooves are formed in the two outer opposite sides;

each of the two power terminal has a front electrical connection section with a U-shaped cross-section and mounted in one of the mounting grooves, the front electrical connection section of each power terminal covering one of the two rectangular block.

9. The eSATA connector as claimed in claim 8, wherein each of the power terminals has a larger volume than each signal terminal of the eSATA terminal set.

10. The eSATA connector as claimed in claim 7, wherein the front electrical connection section of each of the signal terminals of the eSATA terminal set is bent;

the front electrical connection section of each of the first USB terminals is formed upwards with an upper ladder part; and the second USB terminal set is mounted between the eSATA terminal set and the first USB terminal set, wherein the front electrical connection section of each of the second USB terminals is shorter than that of the signal terminal of the first USB terminal set and has a front end formed with a bending part corresponding to a height of the upper ladder part of each first USB terminal.

11. The eSATA connector as claimed in claim 10, wherein the first USB terminal set complies with USB 2.0 protocol standard and has four signal terminals, and the second USB terminal set complies with the USB 3.0 protocol standard and has five signal terminals.

12. The eSATA connector as claimed in claim 10, wherein two rectangular block are formed outwards on the two outer opposite sides of the body near the front surface, respectively; two mounting grooves are formed in the two outer opposite sides;

each of the two power terminal has a front electrical connection section with a U-shaped cross-section and mounted in one of the mounting grooves, the front electrical connection section of each power terminal covering one of the two rectangular block.

13. The eSATA connector as claimed in claim 12, wherein each of the power terminals has a larger volume than each signal terminal of the eSATA terminal set.

* * * * *